United States Patent [19]

Holman et al.

[11] Patent Number: 4,491,150

[45] Date of Patent: Jan. 1, 1985

[54] OUTDOOR WATER HOLDING AND PUMPING SYSTEM

[76] Inventors: Carroll Holman, Rte. 1, Cordell, Okla. 73632; Arley R. Fite, Rte. 1, Box 35, Dill City, Okla. 73641

[21] Appl. No.: 325,987

[22] Filed: Nov. 30, 1981

[51] Int. Cl.[3] ..... F16K 21/18

[52] U.S. Cl. ..... 137/565; 137/390; 137/899; 417/36; 417/211.5; 417/442; 417/503

[58] Field of Search ..... 417/442, 503, 211.5, 417/297.5, 36; 137/565, 899, 386, 390

[56] References Cited

U.S. PATENT DOCUMENTS

| | | | |
|---|---|---|---|
| 832,081 | 10/1906 | Reeve et al. | 417/211.5 |
| 2,303,716 | 12/1942 | Arndt | 417/36 |
| 2,424,657 | 7/1947 | Goodman | 417/36 |
| 2,546,565 | 3/1951 | Schneider | 137/565 |
| 2,840,101 | 6/1958 | Saylor | 137/565 |
| 3,280,841 | 10/1966 | Deutsch | 137/899 |
| 3,943,727 | 3/1976 | Wade | 137/565 |

FOREIGN PATENT DOCUMENTS

| | | | |
|---|---|---|---|
| 56-87110 | 7/1981 | Japan | 137/386 |

*Primary Examiner*—A. Michael Chambers
*Attorney, Agent, or Firm*—Christopher H. Morgan

[57] ABSTRACT

An outdoor water holding and pumping system comprising a water tank into which is recessed a pump housing such that water in the tank surrounds and insulates the housing. A pump is disposed in the pump housing for pumping water from the tank to a desired location. The pump housing has a door providing access to the pump from outside the tank. The system preferably includes a housing conduit which extends from the housing to the base of the tank so that conduits to and from the tank can extend underground, through the tank, and to the pump without being exposed. Reserve conduit means are also preferably provided to provide a reserve supply of water to the pump. The system elements are preferably connected for transporting as a unit.

8 Claims, 2 Drawing Figures

OUTDOOR WATER HOLDING AND PUMPING SYSTEM

BACKGROUND OF THE INVENTION

1. Field of the Invention

This invention relates in general to systems for holding and pumping liquids and more particularly, but not by way of limitation, to outdoor water holding and pumping systems and means for protecting such systems from cold and other environmental conditions.

2. Description of the Prior Art

There are many remote locations where water and other liquids must be held in storage to await pumping to a desired location. For example, on temporary well sites living quarters for those operating the well often require a water tank and pumping system to supply water to the living quarters. In such a situation, a portable tank is delivered to a position near the living quarters and a pump is connected to the tank to convey the water from the tank to the living quarters. Additional water is trucked to the tank when necessary.

A particular problem with these systems has been that the conduits from the tank to the pump and to the living quarters are exposed to the environment and must be insulated to prevent freezing during winter. Often, despite insulation about the conduits and the pump a freeze will occur which prevents water from being conveyed from the tank to the living quarters.

Another problem with the systems utilized in the past is that it is difficult to fill water tanks when the temperature is especially cold. This is because the water in the tank will freeze and produce a barrier to the added water. Furthermore, the tank openings often freeze closed and are difficult to manipulate.

Still another problem in the prior art has been that moving of the water tanks when no longer needed at a particular site requires a difficult dismantling procedure resulting from the mounting and dismounting of the pump, pump base, tank and conduits. Furthermore, all of the insulation material between the tank and pump and living quarters must be disassembled.

It is accordingly an object of the present invention to provide an improved outdoor liquid holding and pumping system, particularly a water holding and pumping system which is less subject to problems associated with cold weather and freezing.

It is also an object of the present invention to provide an improved water holding and pumping system which is easily transported, assembled and disassembled.

It is still another object of the present invention to provide an improved water holding and pumping system which is easier to fill and maintain.

SUMMARY OF THE INVENTION

The present invention provides an outdoor water holding and pumping system which comprises a water holding tank which has an interior, an exterior and a water-containing surface. A pump housing is recessed into the tank through the water-containing surface such that a pump disposed in the housing will be insulated by and yet not submerged in water held in the tank. A pump is disposed in the pump housing for pumping water from the tank. A door encloses the pump within the pump housing and provides access to the pump through the door from the exterior of the tank.

The water-containing surface preferrably includes a ground engaging base portion and a housing conduit means which sealingly extends from the housing through the interior of the tank to the ground engaging base portion. An exterior conduit means for conveying water from the pump to a desired exterior location extends through the housing conduit means to a desired exterior location, preferrably underground. Power supply means can be extended to the pump through the housing conduit means as well. In this manner, the pump and the conduits which convey water from the tank to a desired location are insulated by the water in the tank and by the ground. No additional insulation or heating is necessary in many situations.

The present invention also preferrably includes an interior conduit means for conveying water held in the tank to the pump extending from the interior of the tank through the housing to the pump. This interior conduit means preferrably has an inlet at a first level in the interior of the tank. The system also preferrably includes a reserve conduit means for conveying water held in the tank to the pump extending from the interior of the tank through the housing to the pump and having an inlet at a second level lower than the first level in the interior of the tank. Valve means are provided for switching from the interior conduit means to the reserve conduit means such that a reserve quantity of water can be directed to the pump when water falls below the first level in the tank.

The tank, pump, pump housing, and conduits are all preferably rigidly connected so that the system can be easily transported as a unit.

For a further understanding of the invention and further objects, features and advantages thereof, reference may now be had to the following descriptions taken in conjunction with the accompanying drawings.

DESCRIPTION OF PREFERRED EMBODIMENTS

Figure 1:
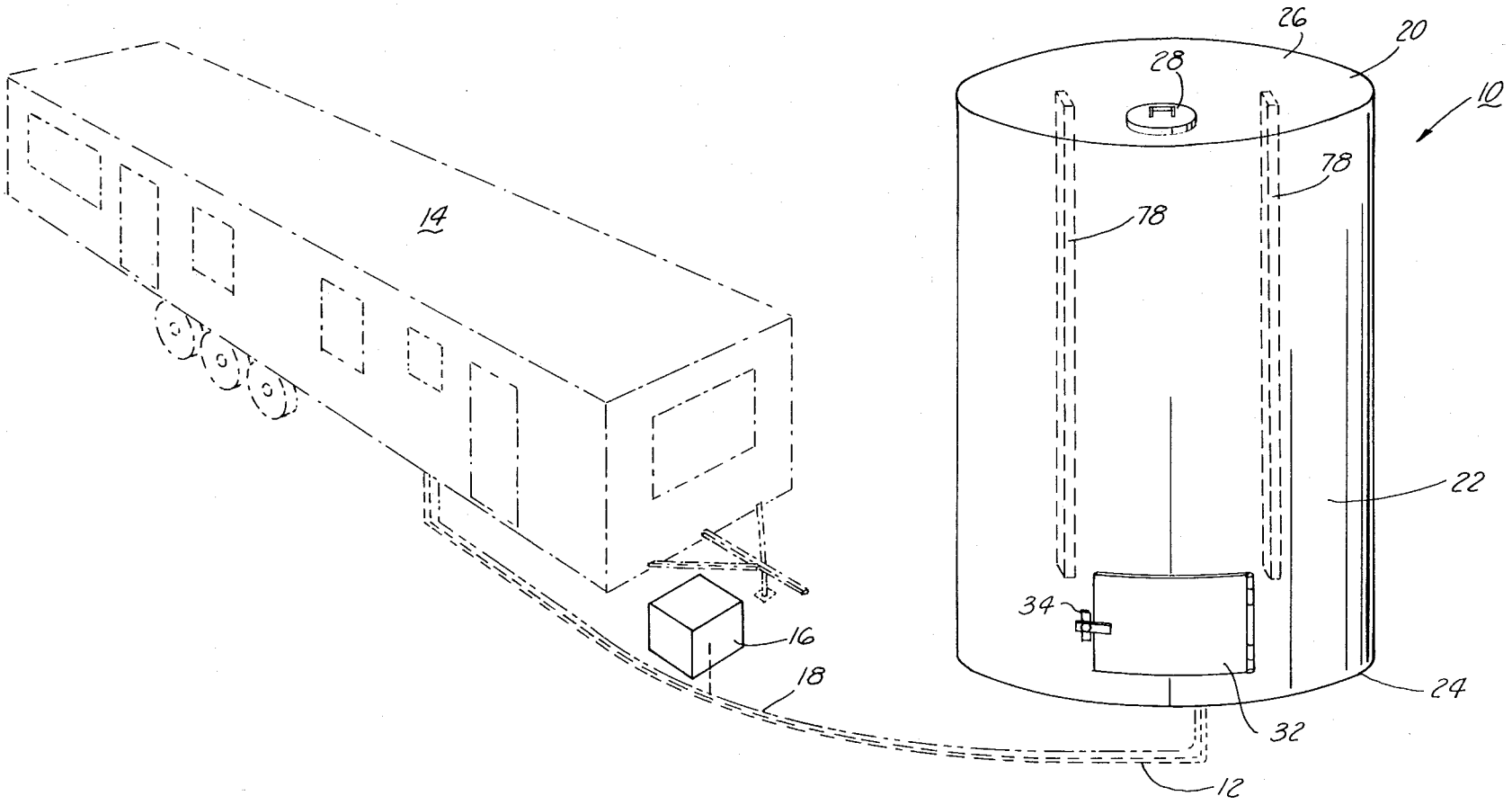
FIG. 1 is a perspective and schematic view of the water holding and pumping system of the present invention.
Figure 2:
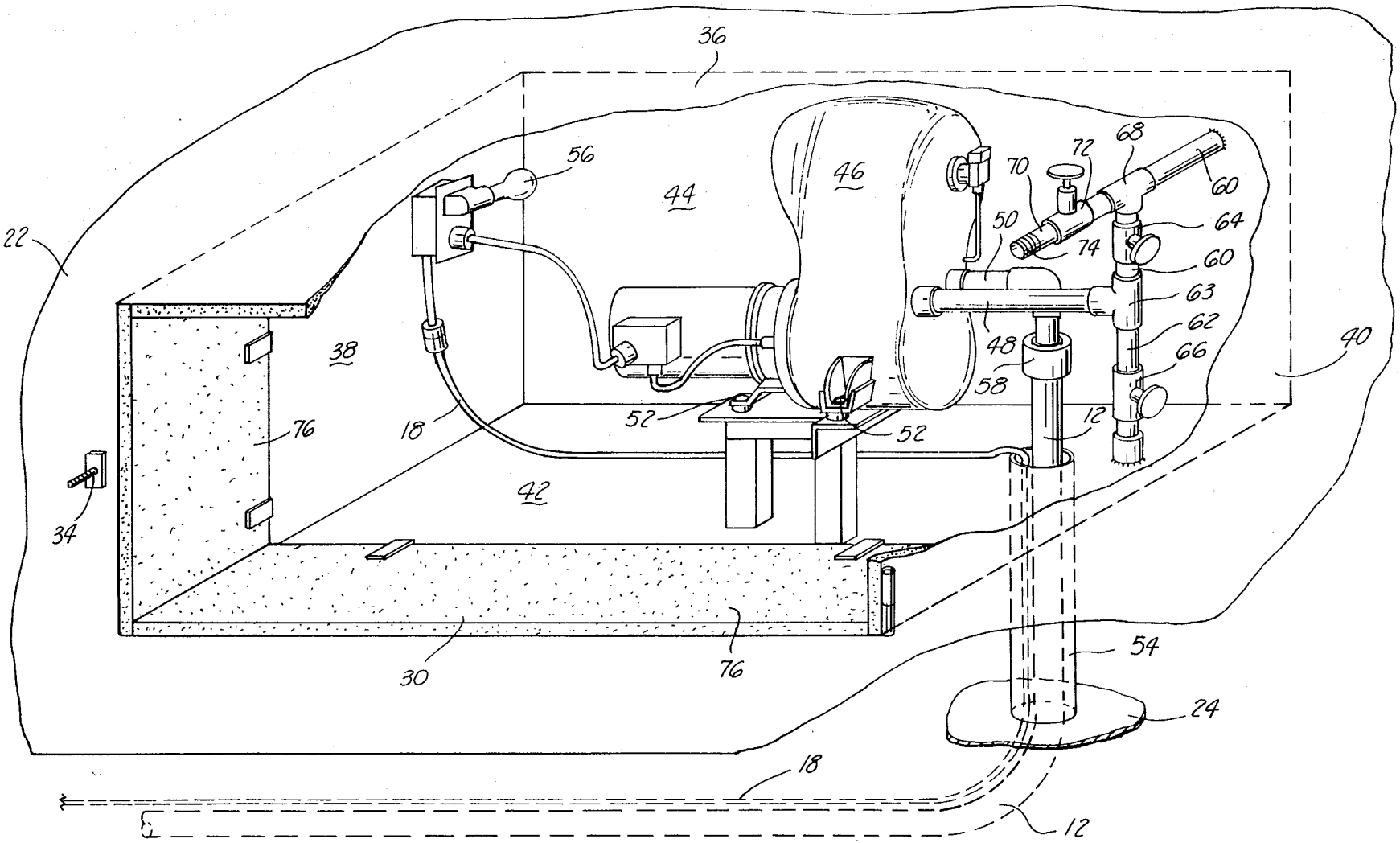
FIG. 2 is a cut away perspective view of the pump housing and pump of the invention shown in FIG. 1.

Referring now to FIGS. 1 and 2, a water tank and pump system of the present invention is shown generally at 10. The system 10 is connected by a water conduit 12 to a mobile home 14. The conduit 12 extends underground from under the pump and tank system 10 to the mobile home 14. An electrical generator 16 is connected by an electrical conduit 18 to the pump and tank system 10. The electrical conduit 18 extends underground parallel to water conduit 12.

The water tank and pump system 10 includes a cylindrical water tank 20. This tank 20 holds water for pumping to the mobile home 14 through conduit 12. The tank 20 includes a cylindrical sidewall 22, a round ground-engaging base 24 and a round top 26.

In a conventional system a tank much like tank 20 is connected by a conduit which extends through the sidewall 22 to a pump mounted on a ground engaging base between the tank 20 and the mobile home 14. A second conduit extends from the pump to the mobile home 14. The conduits between the tank 20, a coventional pump and the mobile home must be insulated and wrapped with heat tape to avoid freezing during winter. The pump itself must be enclosed in a special housing which insulates and heats the pump against freezing as well. An electrical conduit in conventional systems extends over ground from the electrical generator 16 to the conventional pump housing and pump.

In conventional water tanks and the water tank 20 of the present invention a covered access port 28 is provided in the top of tank 20. This access port 28 provides access to the interior of tank 20 for filling, cleaning and the like. In conventionally filling the water tank 20 a water truck brings a load of water to the tank location and the access port 28 is opened. Water from the truck is then pumped into the tank 20 through the access port 28. Because of the relatively high and inaccessable location of access port 28 filling of the tank 20 can be a problem in this conventional filling method. Freezing of the access port cover can also make opening the cover difficult.

Unlike the tanks of the prior art, the tank 20 of the present invention includes a pump housing 30 which is recessed into the interior of tank 20 through the cylindrical sidewall 22. This pump housing 30 is covered by a hinged door 32 which is substantially flush with the cylindrical sidewall 22. A latch 34 is provided on hinged door 32 opposite its hinged connection to cylindrical sidewall 22.

As can be seen, housing 30 is a rectangular box having an upper wall 36, sidewalls 38 and 40, lower wall 42 and rear wall 44. The front of housing 30 is opened and closed by door 32. All of the walls 36 through 42 extend into the interior of tank 20 in the lower part of tank 20 so that housing 30 is normally surrounded by water in tank 20. Housing 30 is waterproof so that water on the interior of tank 20 does not fill housing 30.

Disposed within housing 30 is a water pump 46. The pump 46 has an inlet 48 and an outlet 50. The pump 46 is securely mounted on brackets 52 within housing 30.

The electrical conduit 18 supplies power to pump 46. The electrical conduit 18 extends underground from electrical generator 16 beneath tank 20. A housing conduit 54 extends from the lower wall 42 of pump housing 30 to the base 24 of tank 20 through the interior of tank 20. Electrical conduit 18 extends therethrough. The housing conduit 54 is, of course, sealed to prevent water from entering housing 30. Water in tank 20 surrounds the housing conduit 54.

Attached to electrical conduit 18 is a light 56 mounted on sidewall 38. The light 56 illuminates the interior of housing 30 and in winter it provides some heat to the interior of housing 30 to help prevent freezing.

The exterior underground water conduit 12 extends under tank 20 and through housing conduit 54 into pump housing 30. It is attached to the outlet 50 of pump 46. In this manner, water pumped from tank 20 by pump 46 is conveyed to the mobile home 14. A filter 58 is attached to conduit 12 in housing 30 so that the water conveyed therethrough is filtered of impurities.

Providing means for conveying water to the inlet 48 of pump 46 from the interior of tank 20 is an inlet conduit 60 and a reserve conduit 62. The inlet conduit 60 is connected by a tee connector 63 to the inlet conduit 48 and extends through the upper portion of rear wall 40 of housing 30. The portion of conduit 60 which extends through rear wall 40 is opened providing an inlet for water being conveyed from the interior of tank 20 to pump 46. A valve 64 on conduit 60 regulates the flow of water through conduit 60.

The reserve conduit 62 is connected by tee connector 63 to inlet conduit 48. The other end of conduit 62 extends through the lower wall 42 of housing 30. Conduit 62 opens into the interior of tank 20 so that water can be conveyed from its inlet below rear wall 42 into the pump 46. A valve 66 is provided on conduit 62 to regulate the flow of water through conduit 62.

Pump 46 is provided with a switch which cuts the pump off when air enters inlet 48. This automatic cutoff switch can indicate when a reserve amount of water should be utilized by the opening and closing of valves 64 and 66. For example, after the tank 20 is filled, valve 66 is closed and valve 64 is opened. Water enters through conduit 60 and is pumped by pump 46 until the water level in tank 20 falls below the inlet of conduit 60. At this point the pump 46 automatically ceases operation. By closing valve 64 and opening valve 66 additional water can be conveyed to pump 46 prior to refilling the tank. This is because the inlet of conduit 62 is below the inlet of conduit 60. This reserve amount of water can be utilized while waiting for additional water to be delivered to the tank 20.

Connected by a tee connection 68 to conduit 60 is a filling conduit 70. This filling conduit 70 has a valve 72 for regulating flow therethrough. A threaded connector 74 is provided on the end of filling conduit 70. To fill the tank 20 a filling hose from a tank truck is threaded onto the end 74 of filling conduit 70. Valve 64 is closed and valve 72 is opened. Water is then pumped into the tank 20 from the tank truck. Since conduit 70 is disposed within housing 30 it is less subject to freezing and other adverse effects from the environment.

As can be seen, the housing 17 is disposed within the interior of tank 20. During freezing weather water in tank 20 will begin to freeze at the top level of the water and along the sides inside tank 20. However, because it is usually not sufficiently cold to entirely freeze all of the water in tank 20, water on the interior of tank 20 usually remains just at or above a freezing temperature. The housing 30 utilizes this blanket of non-freezing water as insulation for pump 46 and the inlet and outlet conduits from pump 46. In general, a housing 30 which is recessed eighteen inches into the tank 20 is sufficient to prevent freezing of the pump and its conduits in most winter conditions.

To provide additional protection against freezing in the interior of housing 30 an insulation material 76 is disposed on the outer sides of housing 30 and on the inner side of door 32. This insulation material is held in place by brackets extending from the walls and door.

In extremely cold environments heat tape can be connected to the electrical conduit 18 and wound about vulnerable portions of the pump and conduits. However, because of the insulated position of the pump and conduits less protection need be provided even in extremely cold conditions.

In use, the water holding and pumping system of the present invention is carried to a desired site by a truck. Skids 78 are provided on the back side of tank 20 so that the tank 20 can be horizontally positioned on the bed of a truck. Prior to placing the tank 20 on its base 24 a trench is prepared for the buried conduit 12 and the electrical conduit 18. The tank 20 is then lowered into position so that the water conduit 12 and electrical conduit 18 extending through housing conduit 54 and base 24 fit into the trench which has been prepared. The conduits are then connected to the mobile home 14 and the electrical generator 16. The trench filled to protect and insulate the conduits.

After the tank and pumping system have been installed at the desired location a water truck can fill the tank 20 either through the filling conduit 70 or the access port 28. The filling conduit 70 is easier to use during winter conditions since the conduit 70 is insulated in housing 30 and will remain above freezing. Access to the filling conduit 70 is easily provided through the door 32 at the lower portion of sidewall 22. This lower position for filling is also more convenient than using the access port 28 on top of tank 20.

After tank 20 has been filled pump 46 can be turned on by an appropriately located switch. Generally, it is desirable to initially provide water to pump 46 through inlet conduit 60 only. In this manner, when the water level in tank 20 falls below the inlet of conduit 60 pump 46 will cease operation even when water is demanded. The failure of the pump to operate indicates that the water level is low. At this point valve 64 can be closed and valve 66 opened to provide a reserve amount of water to the pump 46. This reserve amount of water is the amount of water between the inlet of inlet conduit 60 and the inlet of reserve conduit 62. When the reserve water is being utilized additional water can be ordered so that a constant supply will be available.

As can be seen, although the pump 46 and the conduits leading to and from the pump are well insulated they are also easily accessed through door 32. Thus, maintenance and the like is not hindered. In fact, by locating the pump 46 in an insulated location with light readily available maintenance is more easily achieved.

Another important advantage of the present invention is ease of transport. The pump 46, housing 30, tank 20 and the various conduits leading to and from the pump 46 are all rigidly connected. In this manner, they can be transported as a unit to a new location. All that is necessary is to unearth and disconnect the water conduit 12 and the electrical conduit 18 and then raise the tank 20 onto a truck bed for moving to a new location.

Still another advantage of the present invention is that it is relatively immune to vandalism. The water conduit 12 and electrical conduit 18 are buried and are therefore not easily discovered or stolen. Moreover, the rigid enclosure of all the important elements of the water holding and pumping system allows locks to be placed on the door 32 and access port 28 to prevent vandalism to these items and the contents of tank 20.

Thus, the water holding and pumping system of the present invention is well adapted to obtain the objects and advantages mentioned as well as those inherent therein. While presently preferred embodiments of the invention have been described for the purpose of this disclosure, numerous changes in the construction and arrangement of parts can be made by those skilled in the art which changes are encompassed within the spirit of this invention as defined by the appended claims.

The foregoing disclosure and the showings made in the drawings are merely illustrative of the principles of this invention and are not to be interpreted in a limiting sense.

What is claimed is:

1. An outdoor water holding and pumping system for remote locations comprising:

a water holding tank having upper and lower portions including an interior, an exterior and a water containing surface;

a pumping housing having side walls, a bottom and a top recessed into said lower portion of said tank, said side walls, bottom and top substantially surrounded by and in relation to water in said water holding tank such that water in said tank insulates said pump housing against freezing;

a water pump disposed in said pump housing and having an inlet conduit extending through said pump housing to the interior of said tank, said inlet conduit having an inlet opening through which water in said tank is drawn by said pump, said inlet opening residing above said bottom of said pump housing such that when water in said tank falls to the level of said inlet opening, water in said tank still acts to insulate said pump housing and water in said pump against freezing; and a door enclosing said pump within said pump housing and providing access to said pump through said door from the exterior of said tank.

2. The system of claim 1 which further comprises:

a reserve conduit connected to said inlet conduit and having a reserve conduit opening disposed in said tank beneath said inlet opening; and valve means for regulating the flow of water through said inlet conduit and said reserve conduit to said pump such that a reserve quantity of water in said tank between said inlet opening and said reserve conduit opening can be selectively conveyed to said pump by operation of said valve means when water in said tank falls below said inlet opening.

3. The system of claim 1 wherein said water-containing surface has a ground-engaging base portion and which further comprises:

exterior conduit means for conveying water from said pump to a desired exterior location, extending from said pump through said housing and said base portion and underground to a desired exterior location.

4. The system of claim 1 which further comprises:

housing conduit means sealingly extending from said housing through said interior of said tank to said water-containing surface;

exterior conduit means for conveying water from said pump to a desired exterior location, extending from said pump through said housing conduit means to a desired exterior location; and power supply means for powering said pump extending from said pump through said housing conduit means.

5. The system of claim 4 wherein said water-containing surface has a ground-engaging base portion and wherein said housing conduit means sealingly extends from said housing through said interior of said tank to said ground-engaging base portion.

6. The system of claim 1 which further comprises:

an exterior water supply conduit disposed in said pump housing for conveying water from an exterior water supply to said interior of said tank extending through said pump housing to said interior of said tank; and water inlet valve means for regulating the flow of water through said exterior water supply conduit.

7. The system of claim 1 wherein said tank, said pump housing, said pump and said door are all connected for being transported as a unit to a desired location.

8. The system of claim 1 wherein said pump housing is disposed in said tank such that said pump housing is completely surrounded by water in said tank, except at said door.

* * * * *